US008453404B2

(12) United States Patent
Cox

(10) Patent No.: US 8,453,404 B2
(45) Date of Patent: Jun. 4, 2013

(54) COMPOSITE BUILDING PANEL AND METHOD

(76) Inventor: James Edward Cox, Pemberton, NJ (US)

( * ) Notice: Subject to any disclaimer, the term of this patent is extended or adjusted under 35 U.S.C. 154(b) by 0 days.

(21) Appl. No.: 12/806,044

(22) Filed: Aug. 4, 2010

(65) Prior Publication Data

US 2010/0307089 A1 Dec. 9, 2010

Related U.S. Application Data

(63) Continuation-in-part of application No. 11/349,816, filed on Feb. 7, 2006, now abandoned.

(60) Provisional application No. 60/651,160, filed on Feb. 8, 2005.

(51) Int. Cl.
*E04C 1/00* (2006.01)

(52) U.S. Cl.
USPC ..... 52/309.7; 52/800.12

(58) Field of Classification Search
USPC ..... 52/309.7, 309.16, 800.1, 800.12
See application file for complete search history.

(56) References Cited

U.S. PATENT DOCUMENTS 4,875,320 A * 10/1989 Sparkes ..... 52/406.1
5,640,824 A * 6/1997 Johnson et al. ..... 52/578
5,765,330 A * 6/1998 Richard ..... 52/309.13
5,771,645 A * 6/1998 Porter ..... 52/220.2
5,819,498 A * 10/1998 Geraci ..... 52/745.1
6,427,406 B1 * 8/2002 Weaver et al. ..... 52/414
6,519,904 B1 * 2/2003 Phillips ..... 52/309.12
2008/0168733 A1 * 7/2008 Tollenaar ..... 52/481.1
2010/0229489 A1 * 9/2010 Riepe ..... 52/489.2

* cited by examiner

*Primary Examiner* — Jeanette E Chapman
*Assistant Examiner* — Daniel Kenny
(74) *Attorney, Agent, or Firm* — Stuart M. Goldstein

(57) ABSTRACT

A composite building panel and method employs a foam core member which has custom excised cutout sections which are specially configured to be bonded to a panel framework made up of light gauge steel framing members. The panel framework is positioned on the inner surface of the base section of the foam core member and surrounds internal sections of the foam core member. Foam pieces which have been excised from the foam core member are positioned within gaps between the framing members and the foam core member. The framing members, foam core member, and foam pieces are bonded together to form an integral panel component. An external seal coating is permanently affixed to the outer surface of the foam core member. Expandable foam can be injected into the gaps between the framing members and the foam core member, in lieu of the foam pieces, to form the bond between the framing members and the foam core member. A void may be provided in the space over the foam core member and between the framing members for running electrical wiring, plumbing lines, etc. The panel can be used for custom designed walls, roofs and similar structural members.

13 Claims, 8 Drawing Sheets

COMPOSITE BUILDING PANEL AND METHOD

RELATED APPLICATIONS

The herein application claims the benefit of provisional application Ser. No. 60/651,160 filed on Feb. 8, 2005, and is a continuation-in-part of non-provisional application Ser. No. 11/349,816 filed on Feb. 7, 2006.

BACKGROUND OF THE INVENTION

Current methods used in the construction of buildings, including commercial structures, involve the fabrication of wall or roof sections by installing planar exterior surface components onto a multitude of vertically positioned columns. These columns, which will support and protect the interior of the building, are normally spaced evenly to create a substantially rectangular, three dimensional shape. A subsequent interior layer of insulating material is then routinely applied to the interior of the building, directly adjacent to the planar surfaces, in order to establish a thermally efficient barrier. Alternatively, the wall or roof sections may be prefabricated in substantially rectangular sections and then installed onto the building framework to effectively enclose the interior of the building structure.

There are a number of inherent disadvantages to both these commonly utilized construction methods. For instance, these techniques usually require the use of wood, often as the framing material, as the primary building material. However, with the diminishing supply of lumber and a continuing shortage of skilled workers and builders, particularly in the carpentry and framer crafts, the price of wood construction has continued to increase, while the quality of construction has suffered. Wood, utilized as a primary material in both residential and commercial structures, is also vulnerable to deterioration, fire, mold and insect infestation. Moreover, both environmentally conscience builders and their customers are now more reluctant to use wood products, given the adverse impact the continued use of wood has on our natural resources.

Concrete is also used in many instances as a primary construction material. While structures employing concrete construction may last, the cost of materials and labor is high. For example, due to the excessive weight of concrete, extensive foundations are required. Additional time is needed to finish exterior surfaces. These factors and others greatly increase the cost of construction. Concrete structures also are not temperature efficient, which results in higher heating and cooling costs in these structures. In locations at risk of seismic damage, concrete structures are particularly vulnerable, and in situations in which there has been seismic activity, concrete based buildings are irreparable because of the excessive cost and they usually must be demolished.

A more viable alternative to wood or concrete as a primary material for the construction of buildings is lightweight steel. Steel is readily available, relatively inexpensive, and easy to work with. It can be effectively and efficiently utilized for custom pre-fabricated structures and can functionally accept insulation products. Once installed, steel based construction components will last for the life of the building structure and beyond. Steel products can be recyclable, do not materially deplete natural resources, and so are environmentally friendly.

Nonetheless, there is currently no building material which practically and successfully utilizes steel components, combined with appropriate insulation and other building materials, to form a high-strength composite building panel which is functional, versatile, environmentally friendly, and economic to manufacture and install.

SUMMARY OF THE INVENTION

It is thus the object of the present invention to overcome the disadvantages and limitations of existing composite building panel and panel construction methods.

It is the object of the present invention to provide a composite building panel and panel method of construction which consists of a system of constructing buildings, using high strength, light-weight, pre-fabricated composite panels.

It is another object of the present invention to provide a composite building panel and panel method of construction which can be manufactured and installed quickly, easily, and economically.

It is still another object of the present invention to provide a composite building panel and panel method of construction which can be mass produced using currently available process equipment.

It is a further object of the present invention to provide a composite building panel and panel method of construction which can be manufactured utilizing primarily recycled materials, which are readily available.

It is another object of the present invention to provide a composite building panel and panel method of construction which can be custom produced in varying sizes and shapes without significantly increasing costs of manufacture.

It is still another object of the present invention to provide a composite building panel and panel method of construction which can be easily transported and pre-assembled either on or off site.

It is a further object of the present invention to provide a composite building panel and panel method of construction which meets the highest requirements for energy savings.

It is another object of the present invention to provide a composite building panel and panel method of construction which does not contribute to the depletion of natural resources.

It is another object of the present invention to provide a composite building panel and panel method of construction which is fire retardant and mold resistant, has an insect and vermin repellent, and is water impervious.

It is still another object of the present invention to provide a composite building panel and panel method of construction which has an exterior surface having an aesthetically pleasing appearance, such that no other surface need be installed.

These and other objects are accomplished by the present invention, a composite building panel and method which employs a foam core member which has custom excised cutout sections which are specially configured to be bonded to a panel framework made up of light gauge steel framing members. The panel framework is positioned on the inner surface of the base section of the foam core member and surrounds internal sections of the foam core member. Foam pieces which have been excised from the foam core member are positioned within gaps between the framing members and the foam core member. The framing members, foam core member, and foam pieces are bonded together to form an integral panel component. An external seal coating is permanently affixed to the outer surface of the foam core member. Expandable foam can be injected into the gaps between the framing members and the foam core member, in lieu of the foam pieces, to form the bond between the framing members and the foam core member. A void may be provided in the space over the foam core member and between the framing members for running electrical wiring, plumbing lines, etc. The panel can be used for custom designed walls, roofs and similar structural members.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
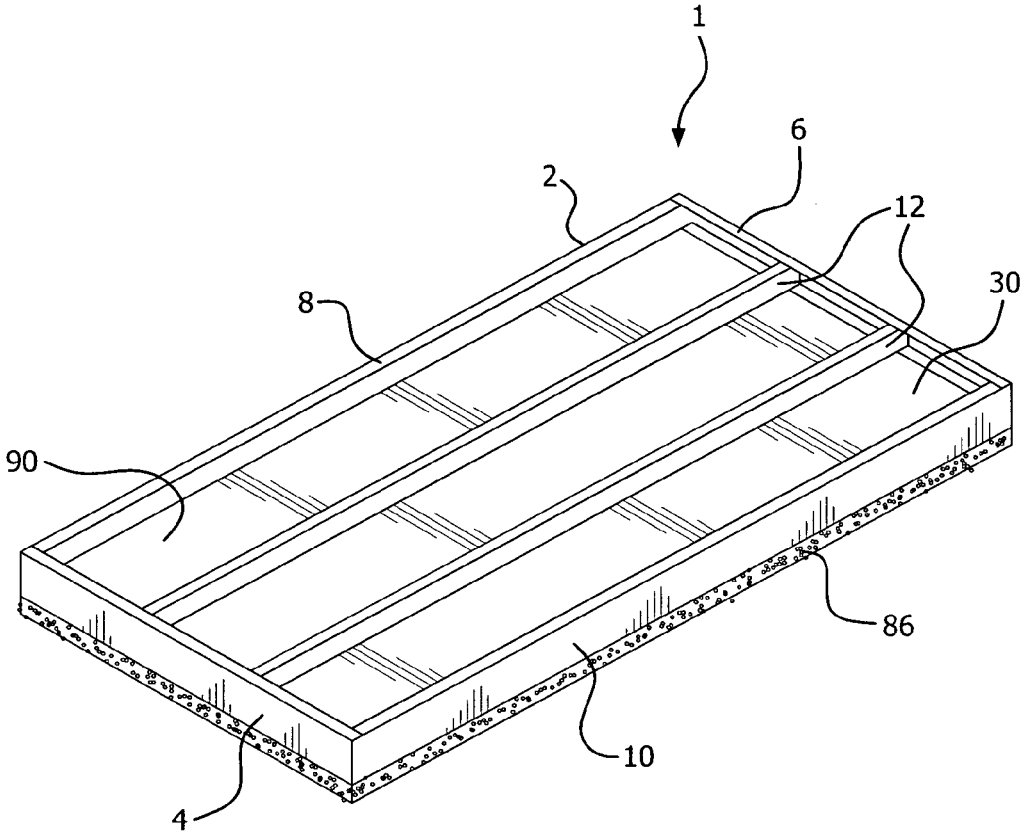
FIG. 1 is a perspective view of the composite building panel of the present invention.

FIG. 1 shows a representative composite building panel 1 of the present invention. Panel 1 comprises panel framework 2 made up of lateral framing members 4, 6, 8, and 10, and intermediate framing members 12. It is to be understood that FIG. 1 depicts a basic panel having a panel framework to be used as a basic rectangular wall or roof component. The invention is not to be considered restricted to this particular design. It is anticipated that the shape of the panel and the configuration of the panel framework and the foam components located therein, as described hereinafter, can be of virtually infinite shape and configuration, depending on the requisite design of the building structure in which the panel is to be used.

FIGS. 2-7 show an example of a basic composite building panel. Lateral framing members 4, 6, 8, and 10 and intermediate framing member 12 are all made of light gauge steel, fabricated from recycled material. Each framing member has opposing edges and cantilevered lip elements extending the length of and from each of the opposing edges. Opposing edges 14 and 16 and cantilevered lip elements 18 and 20 are shown on representative framing member 8, in FIG. 2. The framing members are secured to each other to form panel framework 2 by a plurality of screws, rivets, or equivalent attachment devices 22.

Foam core member 30 made of expanded polystyrene foam, styrofoam, or equivalent material, comprises base section 31 with inner surface 32 and outer surface 33, and internal sections 34 and 36 upstanding from the inner surface. Foam core member 30, originally a rectangular shaped piece of foam, is formed by excising and removing selected pieces, e.g. pieces 42, 44, 46, 48, and 50, to create lateral cutout areas 52, 54, 56, and 58 and central cutout area 60 between internal sections 34 and 36.

Figure 3:
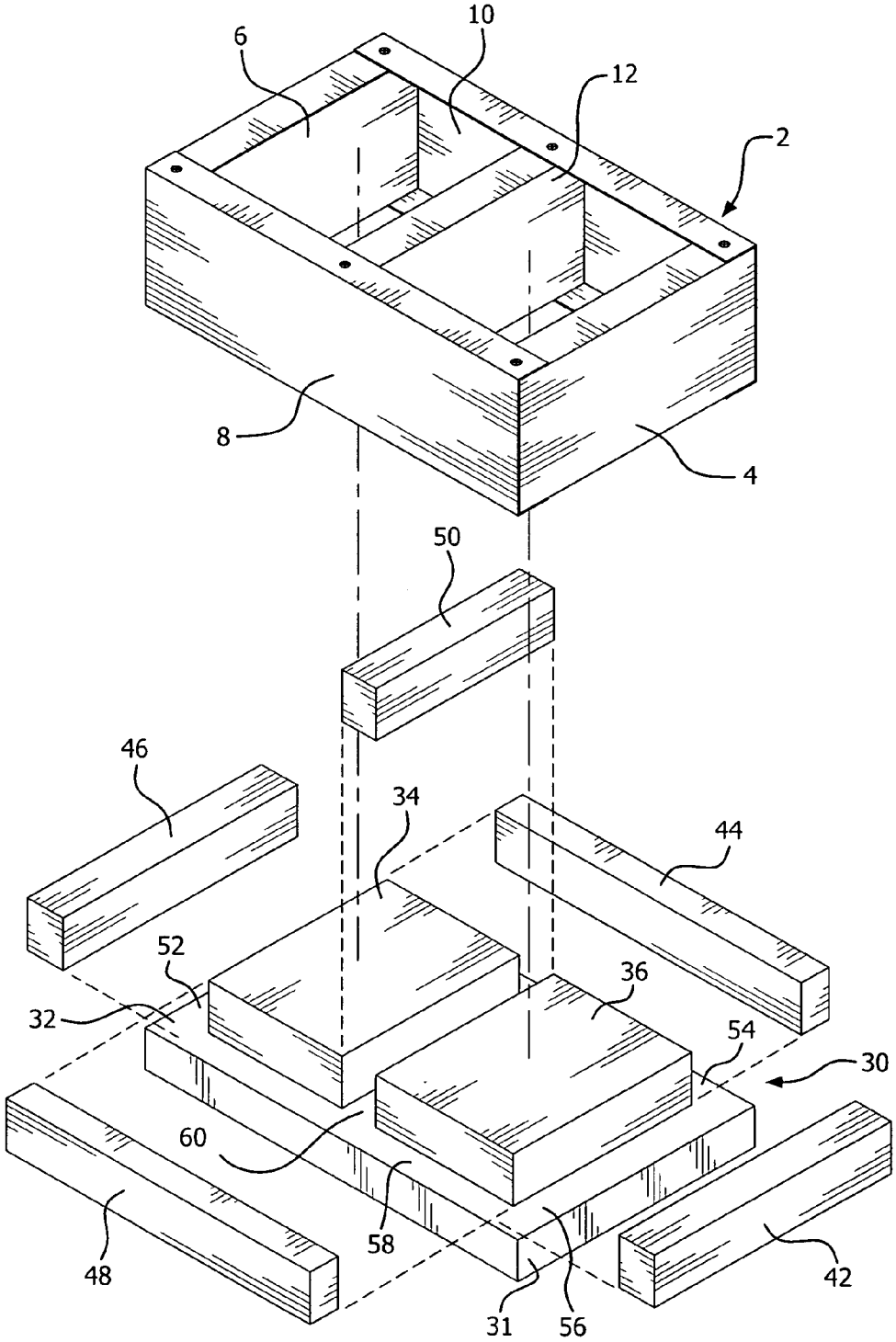
FIG. 3 is a perspective view of the assembled framework and the excised foam core member and its excised pieces of the composite building panel of the present invention.
Figure 4:
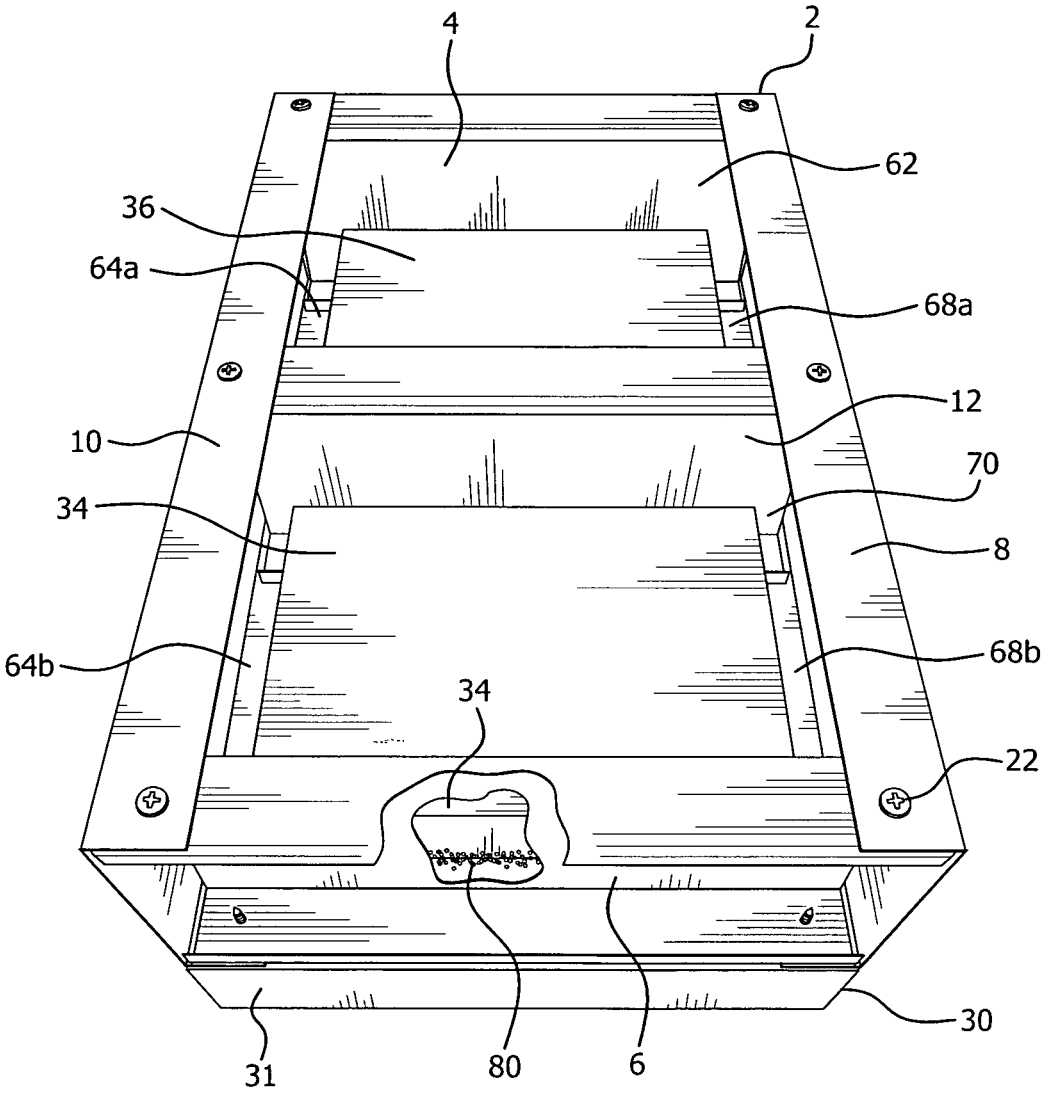
FIG. 4 is a perspective view of the framework in place over the foam core member of the composite building panel of the present invention.

As depicted in FIG. 3, panel framework 2 is inserted into and positioned within foam core member 30 such that lateral framing members 4, 6, 8, and 10 are located within lateral cutout areas 52, 54, 56, and 58 respectively, and intermediate framing member 12 is located in central cutout area 60, each framing member having its lip element resting on inner surface 32 of base section 31. As seen in FIG. 4, when panel framework 2 is so positioned within foam core member 30, gaps 62, 64*a*, 64*b*, 68*a*, 68*b*, and 70 are created between the framing members of the panel framework and the foam core member.

Prior to inserting panel framework 2 into foam core member 30, an appropriate insulation board adhesive 80, e.g. a polyurethane froth adhesive or equivalent, is applied to the contact surfaces between the framing members and foam core member. This serves to permanently bond the panel framework to the foam core member.

Figure 5:
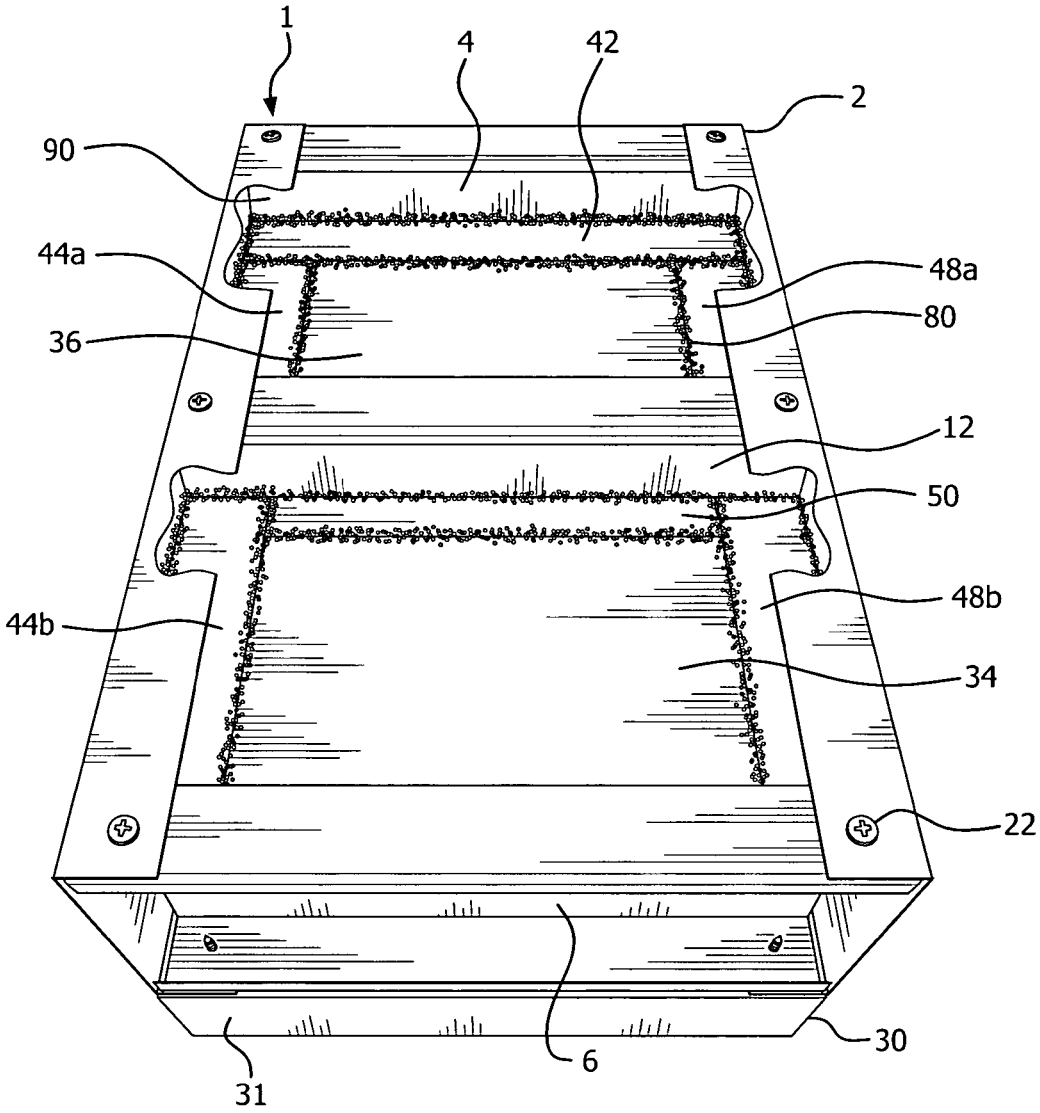
FIG. 5 is a perspective view of the composite building panel of the present invention with its components bonded in place.

In one embodiment of the invention, depicted in FIG. 5, selected foam pieces 42, 44*a*, 44*b* (cut from 44), 48*a*, 48*b* (cut from 48), and 50, previously excised from foam core member 30, are inserted into and substantially fill gaps 62, 64*a*, 64*b*, 68*a*, 68*b*, and 70, respectively. The foam pieces are bonded to foam core member 30 and panel framework 2 also by use of adhesive 80, to form integral, unitary building panel 1, in which the foam core member extends the length and width of the panel.

Figure 6:
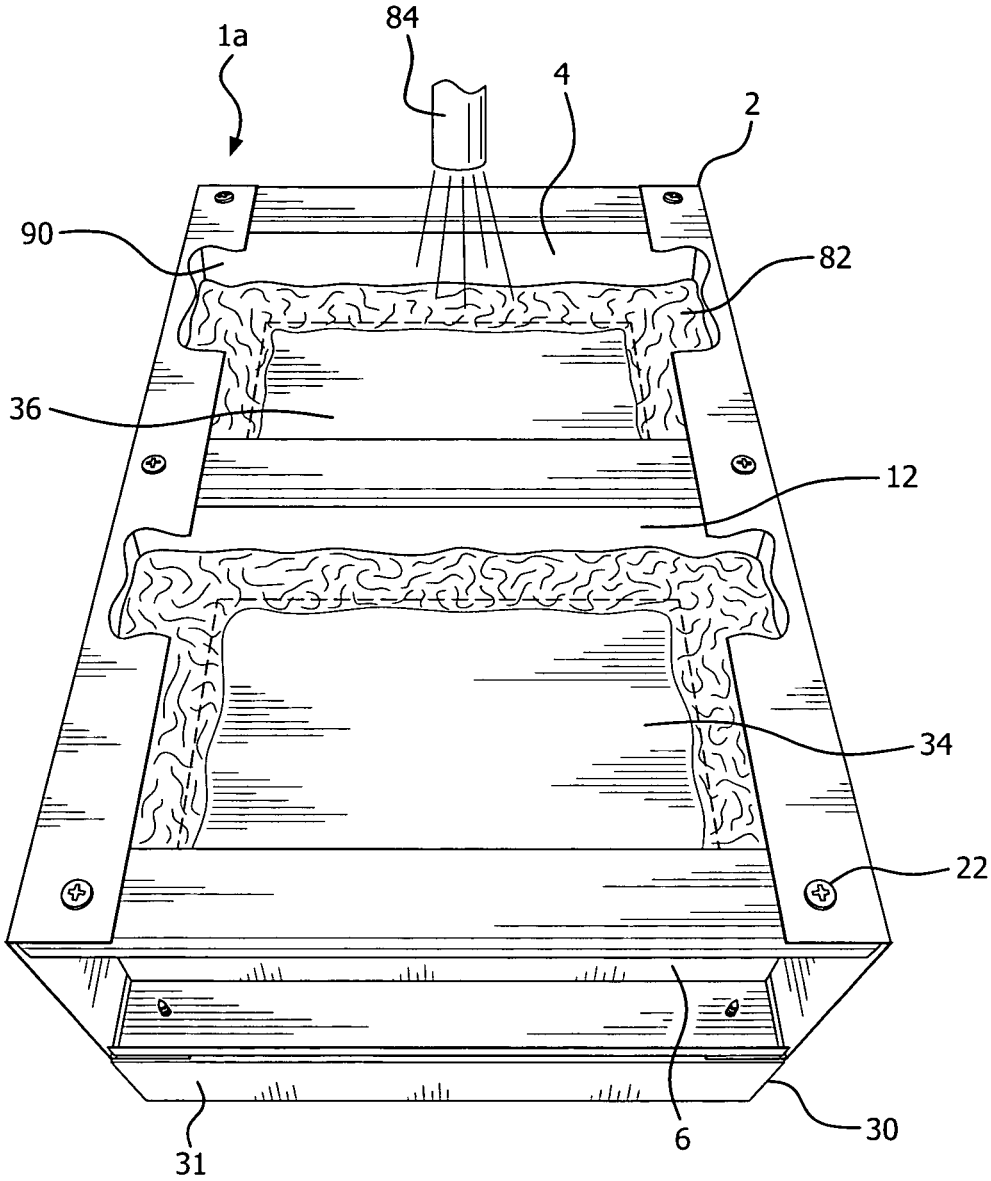
FIG. 6 is a perspective view of an alternate embodiment of the composite building panel of the present invention with its components bonded in place.
Figure 7:
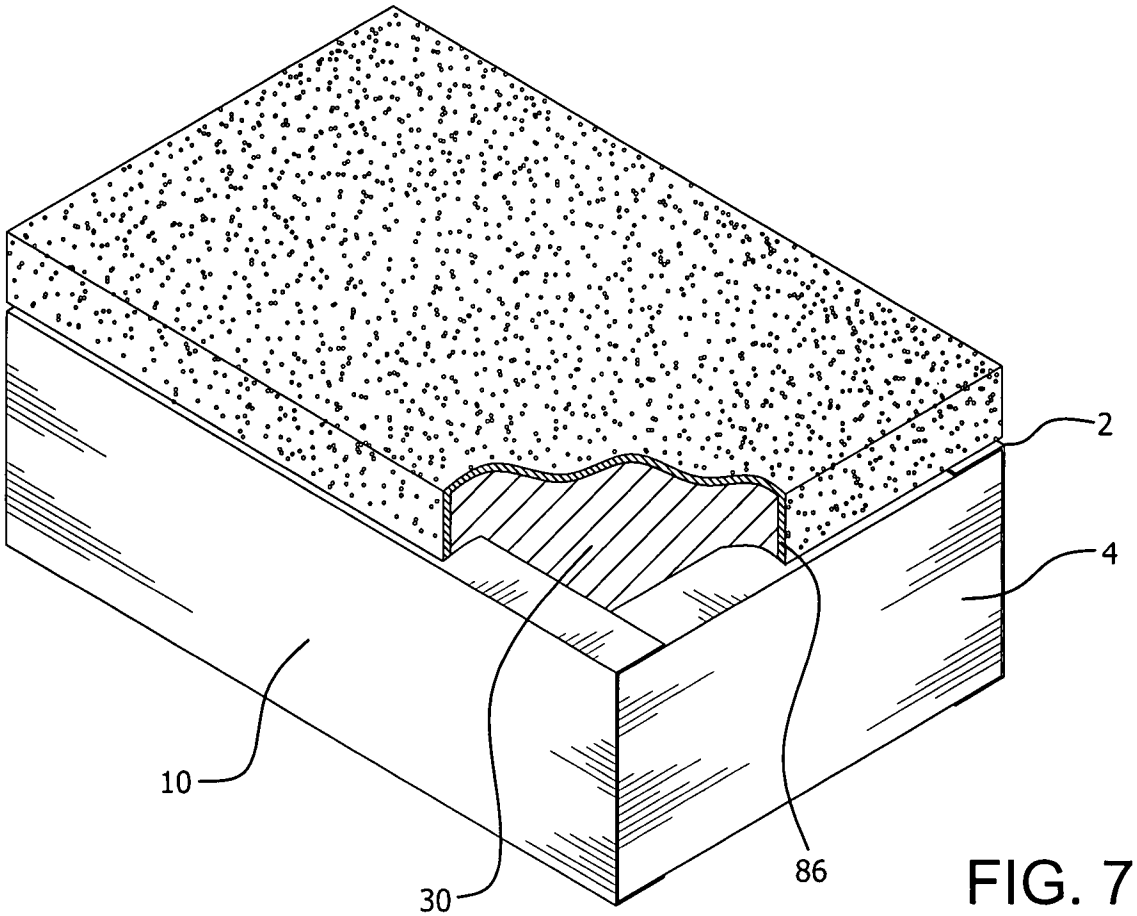
FIG. 7 is a perspective view of the composite building panel of the present invention, showing its finished external surface.

In another embodiment of the invention, depicted in FIG. 6, expandable foam 82 is injected by nozzle 84 or equivalent means into and substantially fills gaps 62, 64*a*, 64*b*, 68*a*, 68*b*, and 70. Foam 82 bonds with foam core member 30 and panel framework 2 to form integral, unitary building panel 1*a*.

After panels 1 or 1*a* are formed, external sealing coat 86, comprising a polyurea and polyurethane blend material, is applied, optimally by spray, to outer surface 33 of base section 31 of core member 30. Sealing coat 86 provides a pleasing, finished appearance to the exterior of panel 1. However, other exterior finishes, including paint, stucco, siding, etc. can be applied, at the preference of the owner.

Figure 2:
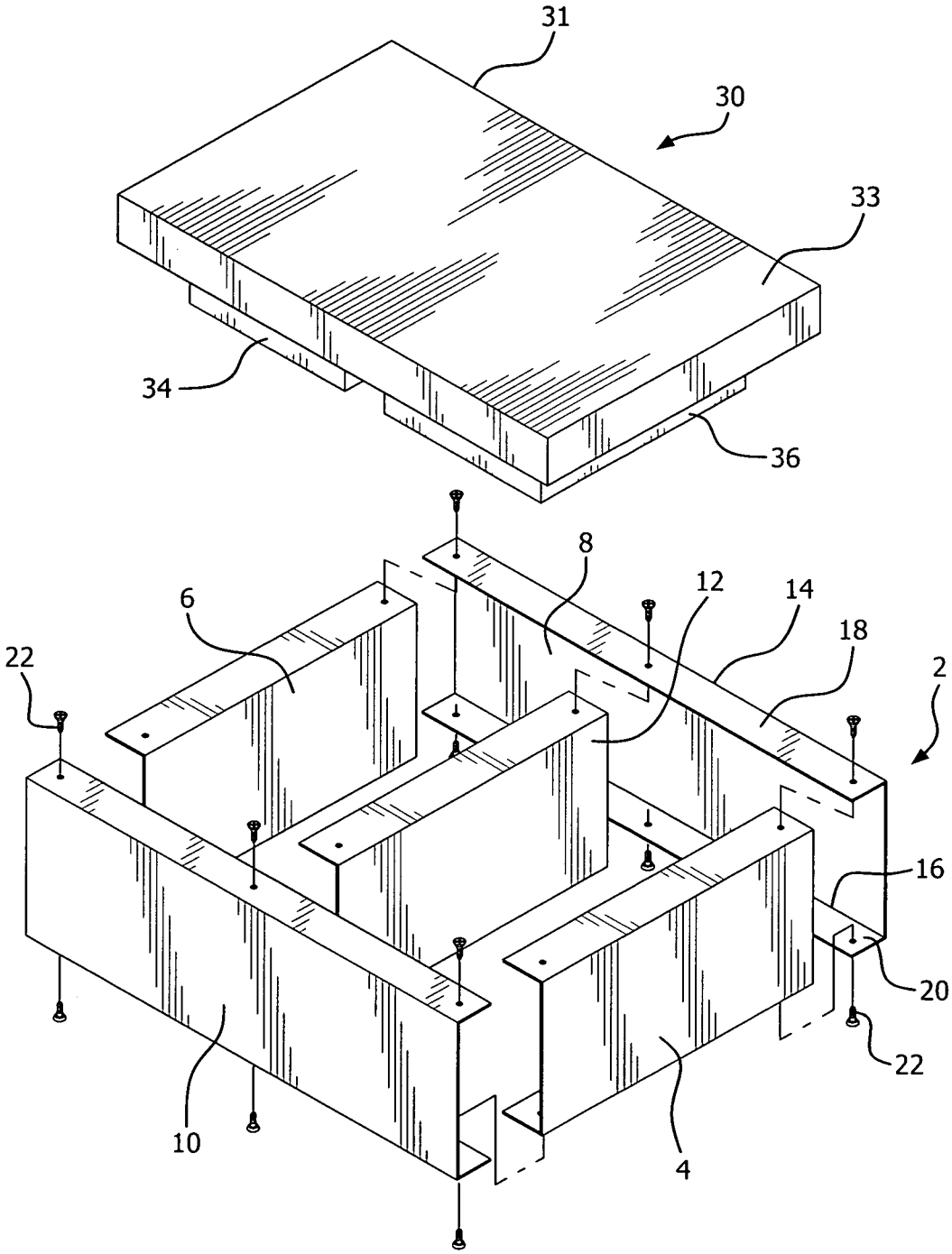
FIG. 2 is an exploded view of the framework and the foam core member of the composite building panel of the present invention.

The method for forming the building panel of the present invention first comprises excising selected pieces 42, 44, 46, 48, and 50 from foam core member 30, thus creating lateral cutout areas 52, 54, 56, and 58 and central cutout area 60. Framing members 4, 6, 8, 10 and 12 are then assembled and secured by means of attachment devices 22 to form panel framework 2. As best seen in FIG. 2, the framing members which make up panel framework 2 are positioned such that their respective cantilevered lip elements are facing inward of the framework. The cantilevered lip elements of intermediate framing member 12 can extend in either direction within panel framework 2.

Panel framework 2 is then positioned over foam core member 30, as depicted in FIG. 3, and inserted into the foam core member, such that lateral framing members 4, 6, 8, and 10 are positioned within lateral cutout areas 52, 54, 56, and 58 respectively, intermediate framing member 12 is positioned within central cutout area 60, and a lip element of each framing member is positioned such that it rests on inner surface 32 of base section 31 of the foam core member.

Prior to inserting panel framework 2 into foam core member 30, adhesive 80 is applied to the contacting surfaces of the framing members and the foam core member, whereby when the panel framework is inserted into the foam core member, the framework becomes permanently bonded to the foam core member.

Excised foam pieces 42, 44*a*, 44*b*, 48*a*, 48*b*, and 50, cut from foam core member 30, are then inserted into gaps 62, 64*a*, 64*b*, 68*a*, 68*b* and 70 to substantially fill these gaps. These excised pieces are then bonded, by means of adhesive 80, to panel framework 2 and foam core member 30 to form integral, unitary building panel 1.

In the alternate embodiment of the invention, after panel framework 2 is bonded to foam core member 30, expandable foam 82 is injected into and substantially fills gaps 62, 64*a*, 64*b*, 68*a*, 68*b*, and 70, thus bonding the foam core member and panel framework to form integral, unitary building panel 1*a*.

Once building panels 1 and 1*a* are formed, external seal coating 86 is provided to outer surface 33 of base section 31 of foam core member 30. Sealant 86 can be sprayed onto outer surface 33 at, for example, 150° and at 3,000 psi.

Building panels 1 and 1*a* can be formed such that there is a void space 90 between the framing members of panel framework 2 and above foam core member 30, which can be used for running electrical wiring, plumbing, and other necessary construction lines. In the alternative, the thickness of foam core member 30 can be increased within panel framework 2 to partially or totally eliminate the void space and thus provide increased insulation for the building panel. However, it is anticipated that with a five inch thick foam core member 30, an insulation value of R25 will be achieved. This rating is commonly recognized as being more than sufficient for most habitable structures. However, as stated above, foam core member 30 can be brought out up to the full extent of the framing members, if additional insulation is required.

Figure 8:
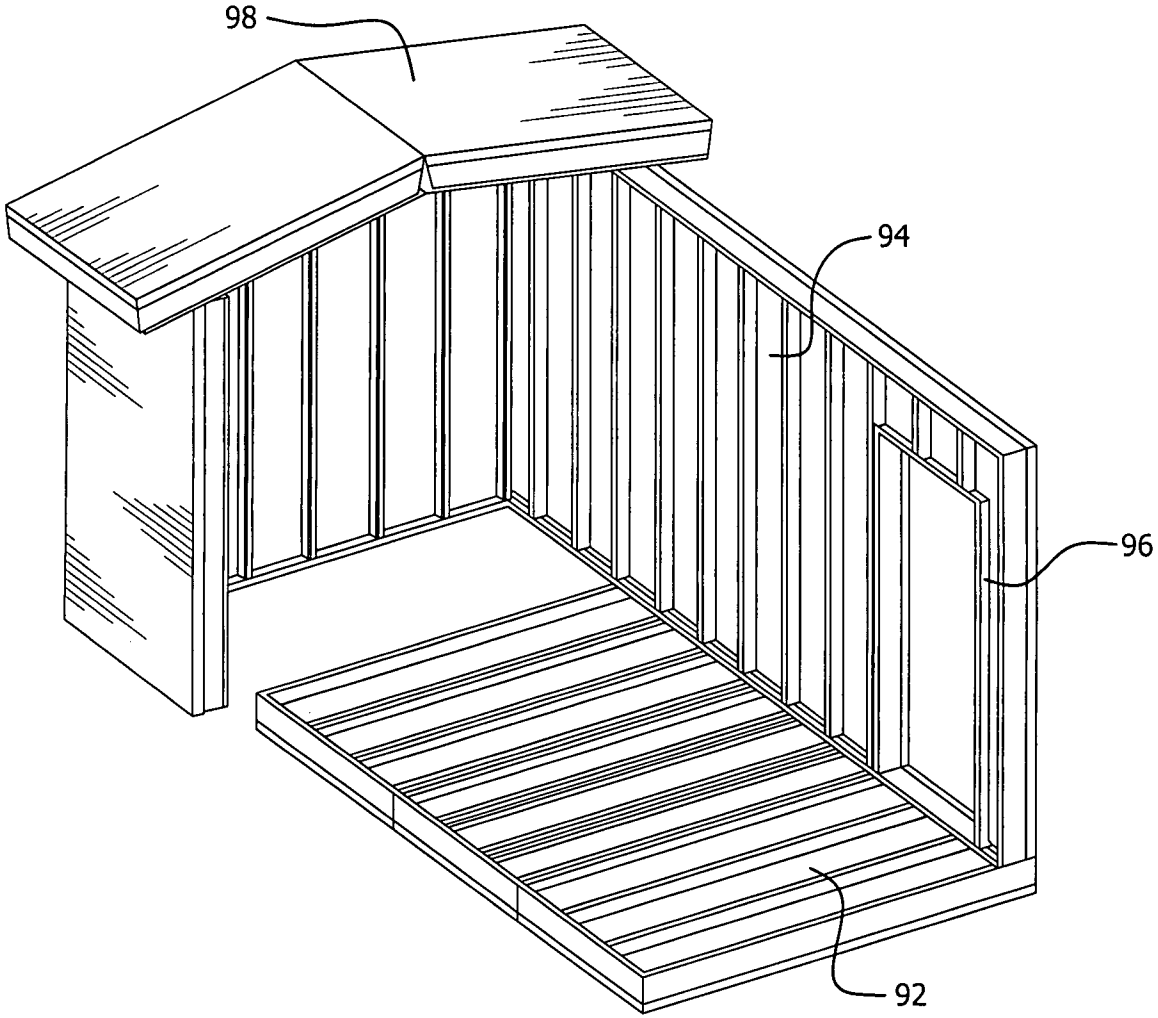
FIG. 8 shows examples of the manner of use of the composite building panel of the present invention.

The completed, integral composite building panel of the present invention, once constructed, can be used for walls, roofs, and other building structures. Interior sheetrock or metal wall members can be secured to the interior lip elements of the framing members in a fashion similar to that which such wall members are secured to metal or wood framing studs. The building panels themselves can be made of any size and can be of any requisite design. See FIG. 8, showing building panels of the invention used for flooring 92, as exterior or interior walls 94, to form a throughway door 96, and as roofing 98.

The composite building panel of the present invention results in a lightweight, prefabricated structure which can be manufactured and easily transported to the worksite. It meets the highest requirements for energy savings, uses recycled material, and presents an exterior surface which can be finished in accordance with the desires of the user. In addition, the building panel is fire retardant and mold resistant, insect and vermin repellant, and water impervious.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A composite building panel component of a wall or roof, each panel component of the wall or roof comprising:

a unitary foam core member extending the length and width of the panel, said foam core member comprising a base section with inner and outer surfaces, internal sections extending from the base section, and cutout areas adjacent to the internal sections;

a plurality of structural framing members forming a panel framework, each framing member having opposing edges and two cantilevered lip elements extending the length of and from each of the opposing edges, the panel framework being positioned within the cutout areas of the foam core member such that a plurality of gaps are formed over the cutout areas and between the framing members and the internal sections of the foam core member, the panel framework being positioned within the cutout areas such that one lip element of each framing member rests on the inner surface of the base section and the other lip element of each framing member is located in spaced relation to and apart from the base section, each lip element of a framing member being secured to an adjacent lip element of an adjacent framing member in the panel framework; and foam inserts located within and filling the plurality of gaps between the framing members and the internal sections of the foam core block member, such that the building panel component comprises two distinct foam components, the unitary foam core member and the foam inserts.

2. The building panel as in claim 1 wherein the foam insert means comprises foam block pieces located in the plurality of gaps between the framing members, the internal sections, and the core block member.

3. The building panel as in claim 2 further comprising means to bond the foam core member, the panel framework, and the foam block pieces together to form a unitary panel structure.

4. The building panel as in claim 3 wherein the means to bond is a polyurethane froth adhesive.

5. The building panel as in claim 1 further comprising an external seal coating permanently fixed to the outer surface of the base section of the foam core member.

6. The building panel as in claim 5 wherein the seal coating is a polyurea and polyurethane blend.

7. The building panel as in claim 1 wherein the foam insert means comprises expandable foam injected into the gaps to bond the panel framework and the foam core member together.

8. The building panel as in claim 1 wherein the panel framework comprises two lateral framing members, top and bottom framing members, and at least one intermediate framing member.

9. The building panel as in claim 8 wherein the intermediate frame member is located between two internal sections of the foam core member.

10. The building panel as in claim 1 further comprising a void space between the framing members and above the foam core member and the foam insert means.

11. The method of forming a building panel comprising the steps of:

providing a foam core member as the core for the building panel;

excising selected pieces from the foam core member to form a base section with inner and outer surfaces, internal sections extending from the base section, and cutout areas;

providing a plurality of structural framing members, each framing member having opposing edges and two cantilevered lip elements extending the length of and from each of the opposing edges;

assembling the framing members to form a panel framework;

inserting the panel framework into the excised foam core member;

positioning the panel framework within the foam core member with the framing members located within the cutout areas and with one lip element of each framing member resting on the inner surface of the base section and the other lip element of each framing member in spaced relation to and apart from the base section, each lip element of a framing member being adjacent to an adjacent lip element of an adjacent framing member in the panel framework such that when the panel framework is positioned within the cut out areas of the foam core, gaps are formed between the framing members and the internal sections;

bonding the panel framework to the foam core member;

substantially filling the gaps with the selected pieces of foam excised from the foam core member;

bonding the foam material to the foam core member and the panel framework to form an integral, unitary building panel.

12. The method as in claim 11 further comprising providing a sealing coat to the outer surface of the base section.

13. The method as in claim 11 wherein the step of assembling the framing members to form a panel framework comprises securing each lip element to its adjacent lip element.

* * * * *